US009680227B2

(12) United States Patent
Johnson et al.

(10) Patent No.: US 9,680,227 B2
(45) **Date of Patent: *Jun. 13, 2017**

(54) ULTRA-WIDEBAND ANTENNA ASSEMBLY

(71) Applicants: Greg Johnson, Aptos, CA (US); Kevin Ketelsen, Aptos, CA (US)

(72) Inventors: Greg Johnson, Aptos, CA (US); Kevin Ketelsen, Aptos, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/855,689

(22) Filed: Sep. 16, 2015

(65) Prior Publication Data

US 2016/0079662 A1 Mar. 17, 2016

Related U.S. Application Data

(60) Provisional application No. 62/050,848, filed on Sep. 16, 2014.

(51) Int. Cl.

| | |
|---|---|
| ***H01Q 9/28*** | (2006.01) |
| ***H01Q 9/20*** | (2006.01) |
| ***H01Q 5/25*** | (2015.01) |
| ***H01Q 5/321*** | (2015.01) |
| ***H01Q 1/42*** | (2006.01) |
| ***H01Q 5/371*** | (2015.01) |

(52) U.S. Cl.
CPC ..... *H01Q 9/28* (2013.01); *H01Q 1/42* (2013.01); *H01Q 5/25* (2015.01); *H01Q 5/321* (2015.01); *H01Q 5/371* (2015.01); *H01Q 9/20* (2013.01)

(58) Field of Classification Search
None
See application file for complete search history.

(56) References Cited

U.S. PATENT DOCUMENTS

| | | | | |
|---|---|---|---|---|
| 3,942,180 | A | 3/1976 | Rannou et al. | |
| 8,059,050 | B1 * | 11/2011 | Johnson | H01Q 1/20 343/773 |
| 8,654,025 | B1 * | 2/2014 | Brock | H01Q 13/04 343/752 |

* cited by examiner

*Primary Examiner* — Robert Karacsony
(74) *Attorney, Agent, or Firm* — John F. Klos; Billion & Armitage

(57) ABSTRACT

An antenna assembly having a pair of feed conductive elements directed in divergent directions, with each pair of conductive elements including a conical sheet conductor and a cylindrical sheet conductor, and radiating wire conductors extending away from each cylindrical sheet conductor. A balun feed system is defined between the pair of conical sheet conductors. A plurality of ferrite-cored inductors are provided on the wire conductors. A tubular radome assembly protects at least the radiating wire conductors from damage from external forces.

17 Claims, 5 Drawing Sheets

ULTRA-WIDEBAND ANTENNA ASSEMBLY

RELATED APPLICATION

This application claims the benefit of U.S. Provisional Application No. 62/050,848, filed Sep. 16, 2014, and incorporated herein by reference.

TECHNICAL FIELD

The invention relates generally to antennas for operation over multiple frequency bands and more particularly to electronic systems intended to detect or suppress (e.g., prevent, disrupt, jam, interfere with or otherwise disable) radio frequency transmissions between transmitters and receivers occurring within particular frequency bands.

BACKGROUND OF THE INVENTION

Radio frequency ("RF") transmission systems and the various wireless devices that operate within such systems are commercially widely available, and nearly ubiquitous, throughout the world with systems corning on-line daily even in the remotest areas of the world. While commercial RF transmission systems are generally thought to improve the overall well-being of mankind and to advance our society, they have found an unintended use in supporting military or terrorist activity of non-friendly countries, organizations, factions, combatants or other groups.

One way by which these non-friendly groups use commercial RF transmission systems is for communication, command, and control. While many commercial RF transmission systems are not secure, their cost and widespread availability, make them an attractive alternative.

Non-friendly groups also use commercial RF transmission systems as detonators for improvised explosive devices ("IEDs"). Typically, combatants fashion an IED using an explosive (e.g., C4), a container (e.g., an unexploded shell) and an RF detonator. The detonator may be wired to a short range wireless remote control device such as an electronic car key, garage door opener, remote control, cordless telephone, or other short range RF transmission device; or to a long range wireless remote control device such as a cell phone, PDA, pager, a WiFi receiver or other long range RF transmission device to enable remote detonation.

The short range wireless devices, by definition, have a "short" or limited range (e.g., approximately 50 meters, more or less) and typically require line-of-sight operation between the device and the IED. Accordingly, these short range wireless devices pose a significant risk to a combatant (e.g. a terrorist, a foe, a member of a non-friendly group or organization, a neutral party, or other combatant) either in the form of risk of detection or risk of injury from the IED itself. However, exceptions arise more frequently as combatants employ more unique methods of remote detonation via RIP transmission, for example, cordless phones.

Existing antennae such as conventional dipoles and monopoles suffer from a number of limitations, including narrow frequency coverage, heavy weight, and high visual profile. Dipoles or monopoles with larger cross-sectional area, referred to as "fat" dipoles, provide increased bandwidth, however, are limited to a 3.5:1 frequency bandwidth before the E plane radiation pattern splits into two lobes with a null perpendicular to the antenna major axis. The discone antenna is capable of operation over frequency bandwidths of 10-15:1, however, the beam peak varies considerably from the horizon with frequency, thus affecting useful range.

Biconical dipoles that are symmetrical are well known, but provide limited capability, e.g., provide bandwidths comparable to "fat" dipoles.

Existing antennae, such as disclosed in Applicant's U.S. Pat. No. 8,059,050, incorporated by reference herein, include relatively exposed radiating elements constructed of flexible wire or the like. The flexible radiating elements are exposed and can deflect in response to contact with obstacles and then return to position. In some environments and situations the flexible radiating elements may be excessively deformed and fail to return to position. This excessive deformation of the radiating elements may lead to degradation of the antenna's electrical performance. A need therefore exists for an antenna assembly offering protection against damage to the radiating elements.

In light of these and other limitations, dangers and risks associated with RF transmission systems, what is needed is a system and method for detecting or suppressing (e.g., preventing, disrupting, jamming, interfering with or otherwise disabling) RF transmissions between target transmitters and/or target receivers operating in a particular region, thereby disabling the communication, the remote detonation or otherwise suppressing the RF transmissions.

SUMMARY OF THE INVENTION

To achieve the foregoing objects, and in accordance with the purpose of the invention as embodied and broadly described herein, a multiple element antenna assembly for a radio frequency communication device is provided.

Embodiments of the invention include an antenna assembly defining a pair of divergent radiating structures each including a feed conductor and a plurality of radiating wire conductors attached to the feed conductor and extending in a predetermined form and direction. The feed conductors each include conical and cylindrical sections. A feedpoint is established between the conical sections of the feed conductors.

A balun is used to prevent radiation of a coax feedline used to connect the antenna to a transmitter/receiver. A frequency range can be optimized by use of a coiled-coax balun including a ferrite rod placed within the coiled-coax solenoid.

A compact, ruggedized, extremely-wide bandwidth antenna is disclosed. The antenna is suitable for operation over a frequency range of at least 80 to 1100 MHZ.

Embodiments of the invention include a transceiver that suppresses one or more signals transmitted from a target transmitter in an RF transmission system to a target receiver in a wireless device operating in the RF transmission system to detect, prevent, disrupt, jam, interfere with or otherwise disable an RF transmission between the target transmitter and the target receiver in the wireless device (i.e., target wireless device).

A protected antenna assembly including one or more dielectric enclosures or radomes is also provided. The antenna assembly may include a polycarbonate tube consisting of one or more sections.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

DESCRIPTION OF THE DRAWINGS

In the accompanying drawings which form part of the specification and wherein like numerals and letters refer to like parts wherever they occur.

DETAILED DESCRIPTION OF THE INVENTION

Figure 1:
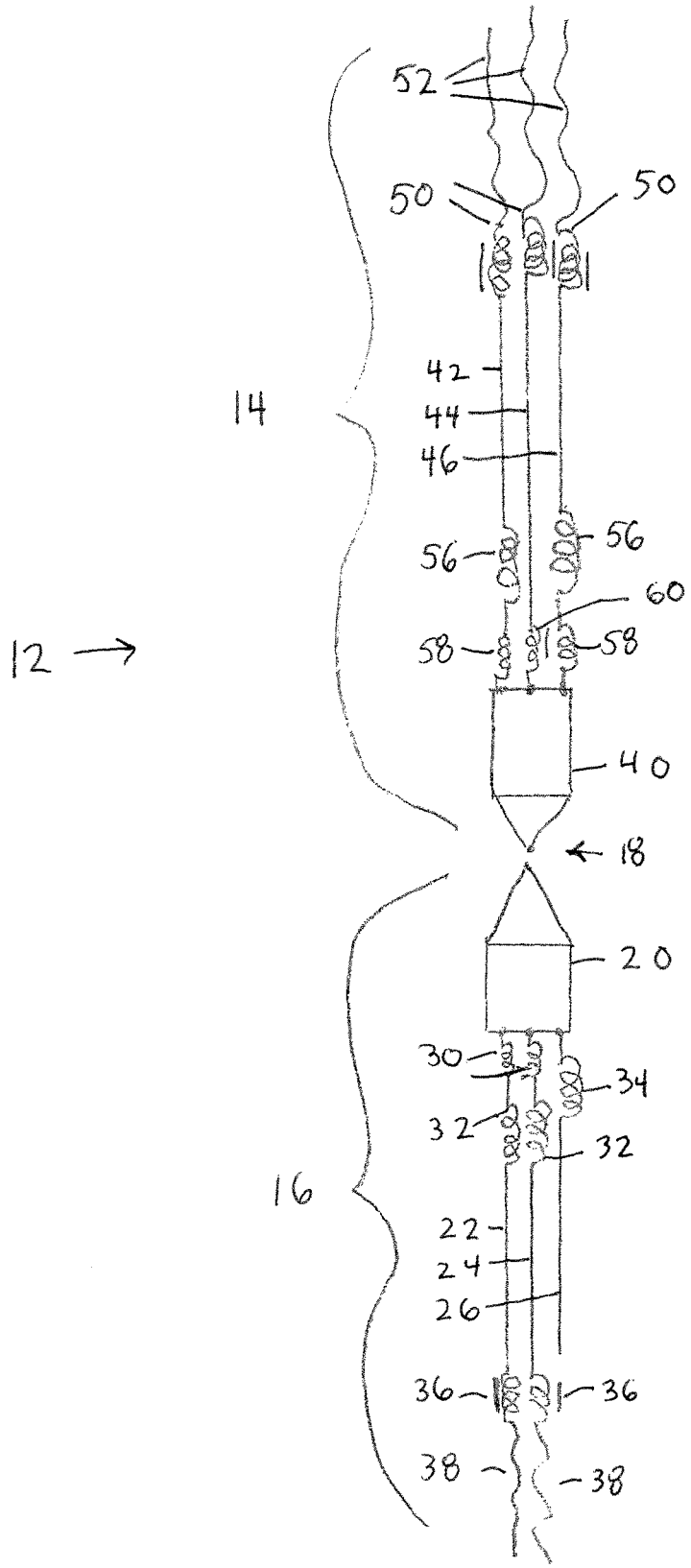
FIG. 1 is an elevation view of components of an antenna assembly of the present invention.

Referring to FIG. 1, antenna 12 includes an upper portion 14 and lower portion 16. An electrical feedpoint 18 is established between upper portion 14 and lower portion 16. Feedpoint 18 may be a 50 ohm feedpoint.

Figure 3:
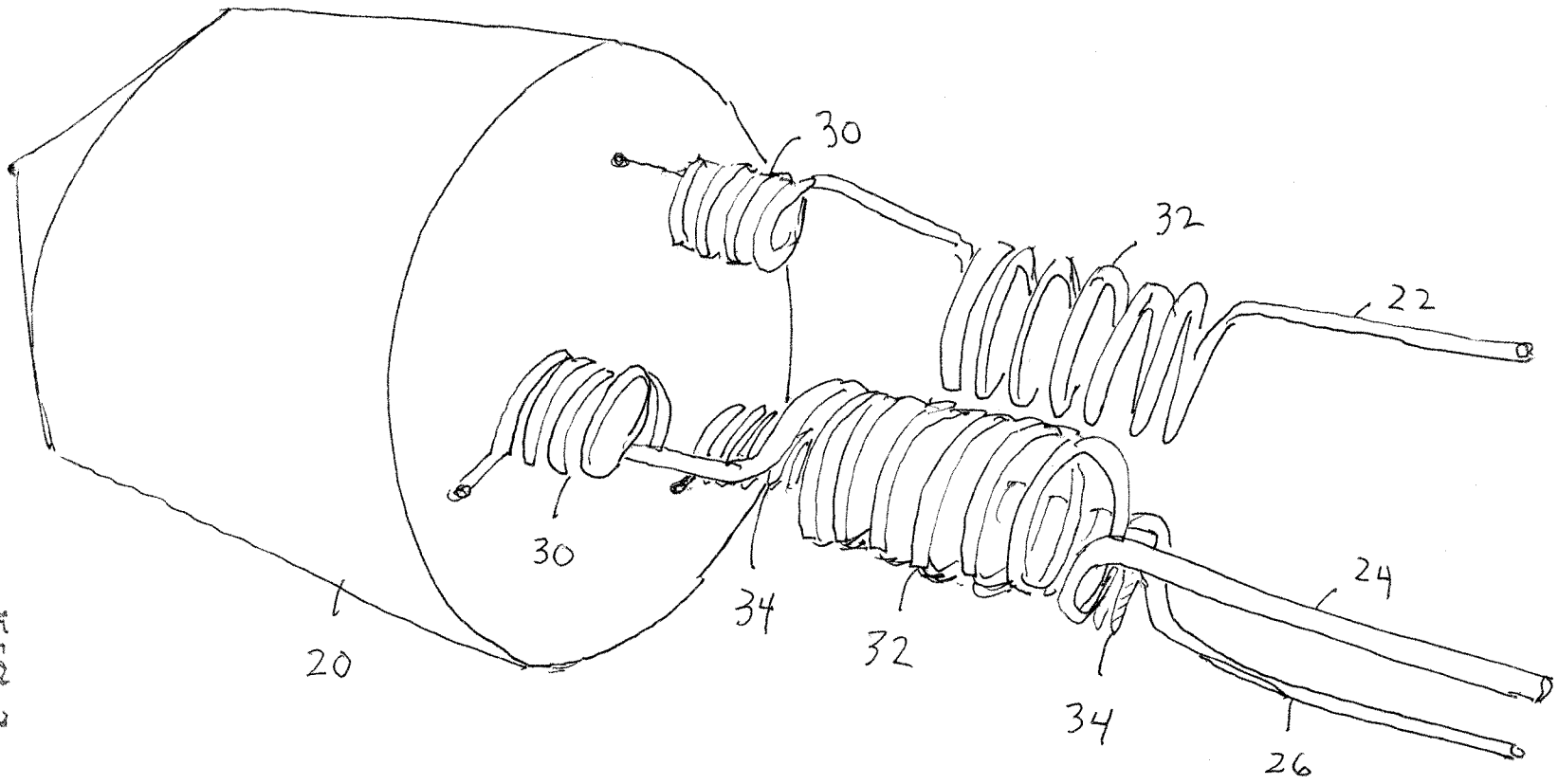
FIG. 3 is a perspective detailed view of a portion of the antenna assembly of FIG. 1.

Lower portion 16 includes a first feed element conductor 20 with a plurality of conductively attached radiating wire conductors 22, 24, 26. Coiled inductors 30, 32, 34 are located on wire conductor elements 22, 24, 26 near feed element conductor 20. Coiled inductors 36, 38 are located at lower ends of elements 22, 24. Inductors 36 include ferrite cores. Wire conductor elements 22, 24, 26 may be spaced 120 degrees apart as shown in FIG. 3.

Figure 4:
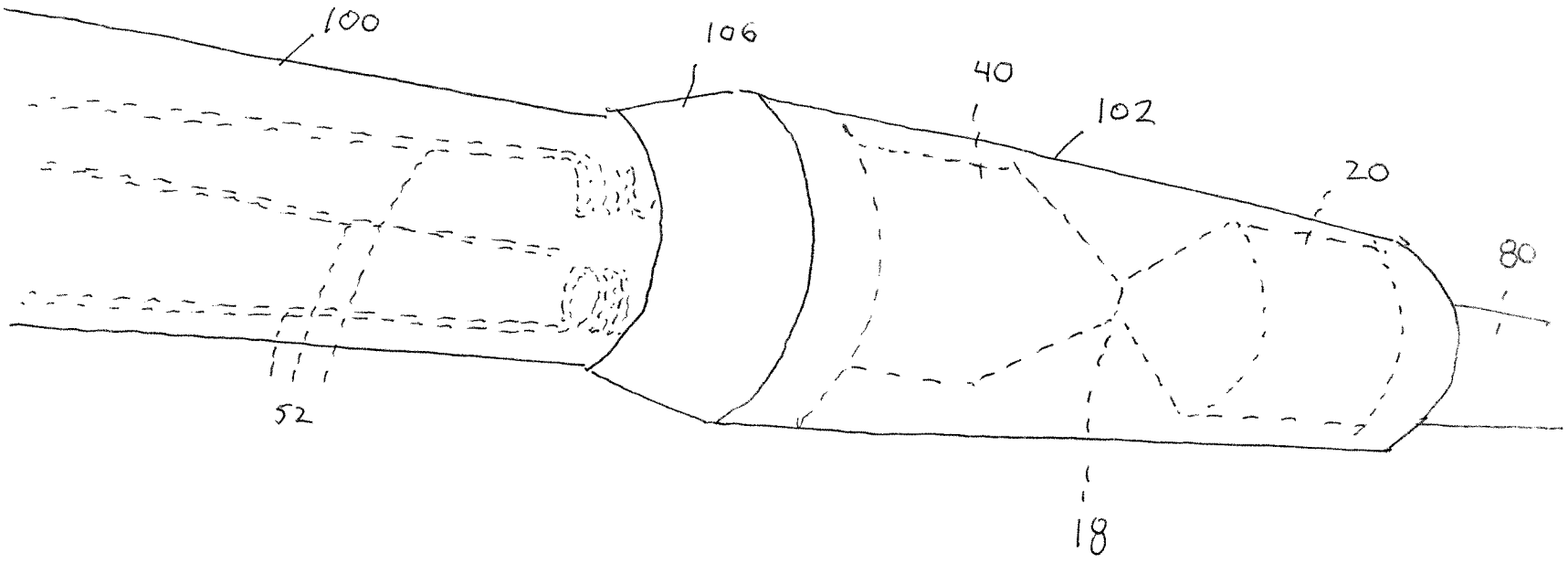
FIG. 4 is a perspective detailed view of the antenna assembly of FIG. 1 shown within a protective radome assembly.

Upper portion 14 includes a second feed element conductor 40 with a plurality of conductively attached radiating wire conductors 42, 44, 46. Coiled inductors 50, 52 are located near ends of wire conductor elements 42, 44, 46. Coiled inductors 50 include ferrite cores. Coiled inductors 56, 58 are located on wire conductor elements 42, 46 near feed element conductor 40. Coiled inductor 60 is located on wire conductor element 44 near feed element conductor 40. Coiled inductor 60 includes a ferrite core. Wire conductor elements 42, 44, 46 may be spaced 120 degrees apart as shown in FIG. 4.

Figure 2:
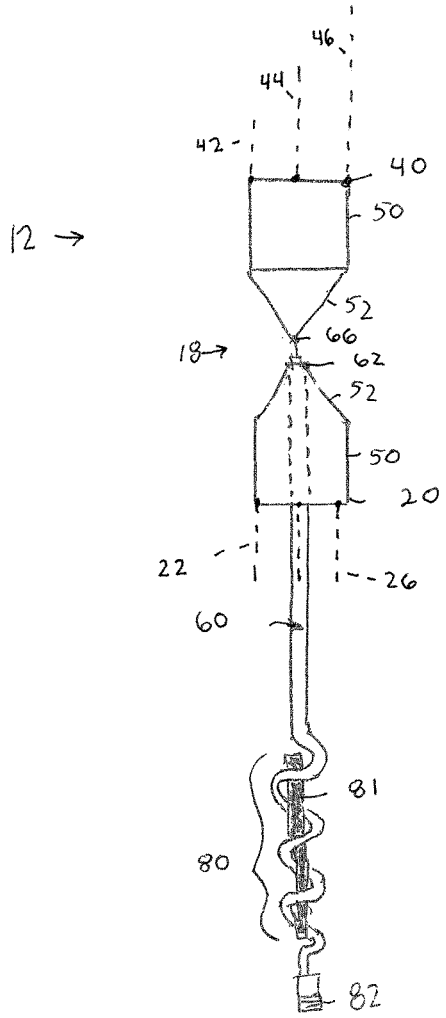
FIG. 2 is an elevation view of the antenna assembly of FIG. 1 including a feed structure.

Referring to FIG. 2, feed conductor elements 20, 40 may be thin sheet metal formed into illustrated shapes. Feed conductor elements 20, 40 each include a generally cylindrical sheet element 50 positioned adjacent a generally cone-shaped sheet element 52. A circular conductive surface defines ends of the feed conductor elements 20, 40. The wire radiating elements 22, 24, 26, 42, 44, 46 are electrically connected to the circular end surfaces of the feed conductor elements 20, 40. Feed conductor elements 20, 40 may be formed of thin metal elements which are soldered or welded together.

Together the first and second feed conductor elements 20, 40 provide broadband operation for the antenna over a large frequency range in the upper part of the antenna's frequency range. The radiating wire conductors provide for operation over a lower frequency range of the antenna.

Antenna 12 is fed at the junction of the two feed conductor elements 20, 40 by a coax signal line 60 which may be positioned along the major axis of the antenna. In one embodiment, antenna 12 is fed by a coax signal line 60 passing through the center of feed conductor element 20. An outer shield 62 of coax signal line 60 is connected to feed element conductor 20. A center conductor of coax signal line 60 is connected to feed element conductor 40 at location 66. A feed balun 80 is located beneath feed conductor 20. Feed balun 80 includes a ferrite core 81. Coax signal line is connected to an RF connector 82.

FIG. 3 illustrates wire elements 22, 24, 26 connected to a circular end surface of feed element conductor 20.

FIG. 4 illustrates a portion of an antenna assembly including a polycarbonate radome section 100 and a portion of a central radome section 102. As needed, a dielectric spacer can be used to keep radiating wire conductors separated within the radome sections. A transition spacer 106 is used to mechanically connect the tubes of radome sections 100, 102 together.

Figure 5:
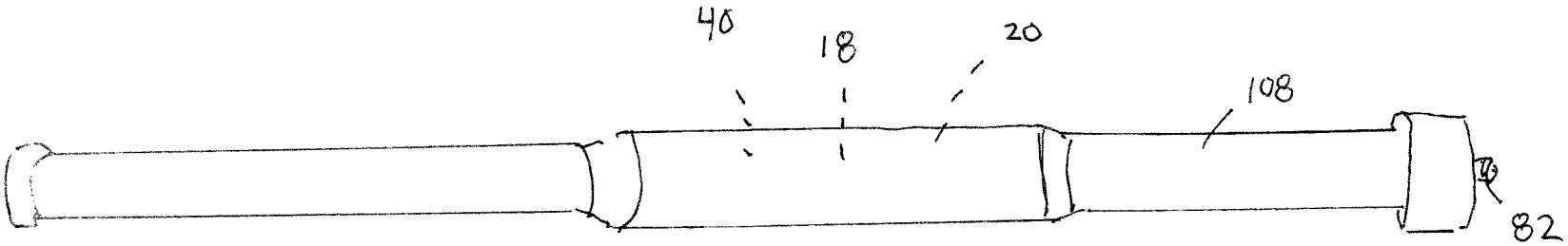
FIG. 5 is a perspective view of the antenna assembly of FIG. 1 shown within a protective radome assembly and having an external electrical connection.

FIG. 5 shows a completed antenna housed inside a plastic radome 108. Additional details of a plastic radome assembly suitable for use in the present invention are disclosed in applicant's U.S. Ser. No. 14/445,045, entitled Biconical Antenna Assembly with Balun Feed, and incorporated herein by reference.

A transceiver and antenna system in accordance with the present invention may be adapted for transportation on a man-worn vest. A transmitting unit includes a transceiver and antenna and may include mounting members that enable transmitting unit to be mounted to a standard protective vest. In other embodiments, a vest may be adapted specifically for carrying transmitting unit. For example, a protective vest may include a pouch, straps, or other adaptations (not shown) for carrying a transmitting unit.

A portable antenna can be used with a transceiver in a defensive manner to detect or suppress RF transmissions from a remote transceiver and/or target receiving device. In some environments, if the target transceiver is unable to initiate or otherwise establish and/or maintain an RF transmission with the target wireless receiving device, the target wireless device may not be used for communication, command and control. In other applications, if the target transceiver is unable to initiate or otherwise establish and/or maintain an RF transmission with the target wireless device, the target wireless device may not be used as, or as part of, a detonator for an IED. Various other embodiments of the invention may thus be used in a defensive manner to detect or suppress RF transmissions to prevent the detonation of IEDs.

A transceiver may initiate or establish RF transmission, including an uplink RF transmission portion and a downlink RF transmission portion, with target receiving device. While illustrated as a wireless device, a transceiver include fixed, wired, or wireless devices capable of establishing RF transmissions with a target receiving device via at least one wireless path that includes an RF transceiver. RF transmissions may be transmitted from a base station or cell tower. In other wireless communication systems, RF transmissions may be transmitted from satellite or ground-based repeaters or other types of RF transmitters as would be apparent to those of ordinary skill in the art. Radiofrequency transmissions are generally well known and further discussion regarding their operation is not required.

A transmitting unit may be adapted for use on a vehicle, such as the US military's HMMWV. Transmitting unit includes a transceiver and antenna and may include mounting members that enable transmitting unit to be mounted to a standard military vehicle. In other embodiments, a transmitting unit may be adapted for air-based platforms, including but not limited to unmanned aerial vehicles.

In other embodiments of the invention, the transceiver may operate (selectably or preset) in frequency bands associated with various mobile telephones, such as, 900 MHz, 2.4 GHz, or other wireless telephone frequency bands. Other mobile telephone frequency bands may include "customized" frequency bands that commercial mobile telephone receivers and transmitters may not be to operate at "out of the box." For example, the "customized" frequency bands may include frequency bands that hostile parties have been able to use in the past (e.g., for remote detonation of IEDs and/or communication) by modifying commercially available wireless telephone components. In some embodiments of the invention, the transceiver may operate (selectably or preset) in frequency bands associated with various short range wireless devices such as an electronic car key, a garage door opener, a remote control, or other short range wireless device. In some embodiments of the invention, the transceiver may operate with various combinations of the wireless frequency bands, the wireless telephone frequency bands, and/or the short range wireless device frequency bands.

In some embodiments, the transceiver may transmit in two, three, four, five, or more different frequency bands. For example, in some embodiments of the invention, the transceiver may operate (selectably or preset) in one or more of the same frequency bands as commercially available wireless communication devices, such as, but not limited to, GSM, CDMA, TDMA, SMR, Cellular PCS, AMPS, FSR, DECT, or other wireless frequency bands.

In some embodiments of the invention, the transceiver may detect RF transmissions to a wireless device located within a volume of influence of the detecting transceiver. This volume of influence may be based on various factors including a range between the target wireless device and the transceiver, a range between the target wireless device and the target transmitter, a range between the target transmitter and the transceiver, a transceiver power, a target transmitter power, a target receiver sensitivity, a frequency band or bands of the transceiver, propagation effects, topography, structural interferers, characteristics of an antenna at the transceiver including gain, directionality, and type, and other factors.

In some embodiments of the invention, the volume of influence may be selected or predetermined to be larger than a volume impacted by the detonation of the IED (i.e., the detonation volume or "kill zone"). In some embodiments of the invention, the volume of influence may be selected or predetermined based on whether the transceiver is stationary (e.g., at or affixed to a building or other position) or mobile (e.g., in or affixed to a vehicle, person, or other mobile platform).

In those embodiments where the transceiver is mobile, the volume of influence may be selected or predetermined based on a speed, either actual or expected, of the mobile platform. In some embodiments of the invention, multiple antennas and transmitters may be used to define an aggregate volume of influence. This aggregate volume of influence may be used to detect and/or suppress RF transmissions around a stationary position such as, for example, a base, a building, an encampment or other stationary position, or a mobile position such as a convoy of vehicles, a division of troops or other mobile position. In further embodiments, the multiple antennas and transceivers may also transmit at different frequencies to suppress RF transmissions from a wide variety of wireless devices.

In some embodiments, the invention may be sized and/or configured to be mounted in, affixed to, or otherwise carried in a military vehicle or a civilian vehicle (e.g., an armored civilian vehicle) such as HMMWV or other military vehicle, a GMC Tahoe, a Chevrolet Suburban, a Toyota Land Cruiser, or other civilian vehicle. In some embodiments, the invention may be sized and/or configured to be carried by a person in a backpack, case, protective vest, body armor or other personal equipment or clothing.

In some of these embodiments, an antenna operating with the transceiver may be affixed to a head apparatus of the person, such as a hat or helmet, or be hand-held. In some embodiments, various components of the antenna may be housed in a ruggedized, sealed, and/or weatherproof container capable of withstanding harsh environments and extreme ambient temperatures.

According to various embodiments of the invention, the antenna and transceiver may be deployed with additional technologies. For example, the antenna and transceiver may be deployed with technologies designed to assess and screen persons, parties, and/or vehicles approaching a designated location, such as, for instance, checkpoints and/or facilities. The screening technologies may be designed to detect bombs being transported by people, within vehicles, or other (e.g., vehicle borne LEDs used in suicide attacks).

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

The invention claimed is:

1. A biconical antenna assembly comprising:

a pair of conductive feed elements directed in divergent directions, with each of the pair of conductive elements including a first generally conical sheet conductor and a first generally cylindrical sheet conductor, and a plurality of radiating wire conductors conductively attached to and extending away from the cylindrical sheet conductors, with each of the plurality of radiating wire elements having a free end and multiple inductors including at least one ferrite-cored inductor spaced apart along a length of the radiating wire element, wherein the free ends of the plurality of radiating wire elements are enclosed within a tubular radome.

2. The biconical antenna assembly of claim 1 wherein the plurality of radiating wire conductors are generally equally spaced around the cylindrical sheet conductors.

3. The biconical antenna assembly of claim 1 wherein a radiofrequency feed point is defined between the first conical sheet conductor and the second conical sheet conductor.

4. The biconical antenna assembly of claim 3 wherein the feed point includes a balun.

5. The biconical antenna assembly of claim 4 wherein the balun includes a coiled section of a coax signal line and a ferrite rod.

6. The biconical antenna assembly of claim 5 wherein a center conductor of a coax signal line is connected to the first conical sheet conductor and a shield conductor of the coax signal line is connected to the second conical sheet conductor.

7. The biconical antenna of claim 6 wherein the coax signal line extends through a center opening in the second conical sheet conductor.

8. The biconical antenna of claim 1 wherein the radome includes at least one dielectric spacer element for separating the radiating wire conductors.

9. The biconical antenna of claim 8 wherein the radome includes at least one dielectric transition element for mechanically connecting a pair of generally tubular radome sections together.

10. The biconical antenna of claim 1 wherein the radome includes a foam filler inserted into one or more cavities.

11. A biconical antenna assembly comprising:

an upper feed element including a first generally cylindrical sheet conductor and a first generally conical sheet conductor, with the first cylindrical sheet conductor conductively attached to a first plurality of radiating wire conductors, said wire conductors extending away from the first cylindrical sheet conductor and defining a plurality of free ends, and with a plurality of wire conductors including ferrite-cored inductors;

a lower feed element including a second generally conical sheet conductor and a second generally cylindrical sheet conductor, with the second cylindrical sheet conductor attached to a second plurality of radiating wire conductors extending away from the second cylindrical sheet conductor and defining a plurality of free ends, said second plurality of radiating wire conductors extending in generally opposite directions as compared to the first plurality of radiating wire conductors, and with a plurality of wire conductors including ferrite-cored inductors;

a feedpoint adapted for connection to an RF transceiver, said feedpoint being defined between the first cylindrical sheet conductor and the second cylindrical sheet conductor of the upper and lower feed elements; and a tubular radome for containing the plurality of free ends of the plurality of radiating wire conductors, said radome protecting the plurality of wire conductors from deformation from external forces.

12. The biconical antenna assembly of claim 11 wherein the feedpoint includes a pair of conductors, with one of the pair of conductors connected to the upper feed element and the other conductor being coupled to the lower feed element.

13. The biconical antenna assembly of claim 11 wherein a coax signal line extends through the lower feed element and terminates at the feedpoint.

14. The biconical antenna assembly of claim 11 further comprising a balun.

15. The biconical antenna assembly of claim 14 wherein the balun includes a coiled section of a coax signal line and a ferrite rod.

16. The biconical antenna of claim 11 wherein the radome includes at least one dielectric spacer element for separating the radiating wire conductors.

17. A biconical antenna assembly comprising:

an upper feed element including a first generally cylindrical sheet conductor and a first generally conical sheet conductor, with the first cylindrical sheet conductor conductively attached to a first plurality of radiating wire conductors, said wire conductors extending away from the first cylindrical sheet conductor, and with a plurality of wire conductors including ferrite-cored inductors, wherein each of the wire conductors includes three inductors;

a lower feed element including a second generally conical sheet conductor and a second generally cylindrical sheet conductor, with the second cylindrical sheet conductor attached to a second plurality of radiating wire conductors extending away from the second cylindrical sheet conductor, said second plurality of radiating wire conductors extending in generally opposite directions as compared to the first plurality of radiating wire conductors, and with a plurality of wire conductors including ferrite-cored inductors, wherein each of the wire conductors includes at least two inductors, said plurality of radiating wire conductors being generally equally spaced apart around a generally circular surface;

a feedpoint adapted for connection to an RF transceiver, said feedpoint being defined between the first cylindrical sheet conductor and the second cylindrical sheet conductor of the upper and lower feed elements; and a generally tubular radome enclosing the upper and lower feed elements.

* * * * *